United States Patent [19]

Soinski et al.

[11] Patent Number: 4,466,497

[45] Date of Patent: Aug. 21, 1984

[54] WIRELINE CORE BARREL

[76] Inventors: Alexander F. Soinski, 1228 Hermosa St.; Frederick J. Soinski, 2810 Orchard Ave.; William R. Soinski, 620 Oxbow Rd., all of Grand Junction, Colo. 81501

[21] Appl. No.: 359,826

[22] Filed: Mar. 19, 1982

[51] Int. Cl.[3] ..... E21B 25/02

[52] U.S. Cl. ..... 175/246; 175/236

[58] Field of Search ..... 175/246, 247, 248, 236, 175/257–261; 160/214, 215

[56] References Cited

U.S. PATENT DOCUMENTS

| | | | |
|---|---|---|---|
| 2,099,859 | 11/1937 | Macready | 175/248 |
| 2,120,240 | 6/1938 | Chappell | 175/248 |
| 2,239,996 | 4/1941 | Chappell | 175/248 X |
| 2,263,639 | 11/1941 | Muhlbach | 255/72 |
| 3,047,081 | 7/1962 | Pitcher | 175/239 |
| 3,103,981 | 9/1963 | Harper | 175/236 |
| 3,120,282 | 2/1964 | Pickard | 175/247 X |
| 3,127,943 | 4/1964 | Mori | 175/246 |
| 3,323,604 | 6/1967 | Henderson | 175/244 |
| 3,333,647 | 8/1967 | Karich et al. | 175/247 |
| 3,346,059 | 10/1967 | Svendsen | 175/246 |
| 3,485,310 | 12/1969 | Milosevich | 175/246 |
| 3,701,389 | 10/1972 | Egnelov et al. | 175/246 |
| 3,739,865 | 6/1973 | Wolda | 175/244 |
| 3,777,826 | 12/1973 | Wolda | 175/46 |
| 3,871,487 | 3/1975 | Cooper et al. | 175/248 |
| 3,874,464 | 4/1975 | Sweeney | 175/58 |
| 3,977,482 | 8/1976 | Reed et al. | 175/246 |
| 4,002,213 | 1/1977 | Sweeney | 175/58 |
| 4,187,919 | 2/1980 | Lambot | 175/246 |
| 4,276,932 | 7/1981 | Saliger et al. | 166/214 |
| 4,281,722 | 8/1981 | Tucker et al. | 175/57 |

*Primary Examiner*—Ernest R. Purser
*Assistant Examiner*—Michael Starinsky

[57] ABSTRACT

A wire line core barrel for retrieving a core sample within a drill string. The wire line core barrel includes a conventional inner tube and also includes a generally cylindrically shaped retrieving assembly disposed above a generally cylindrical elongate body having a fluted periphery comprising a plurality of longitudinal ribs and longitudinal channels. Means for attaching the inner tube assembly to the drill string are mounted on the ribs of the elongate body. The channels of the elongate body provide a straight, longitudinal passageway for fluids flowing through the drill string.

7 Claims, 10 Drawing Figures

LATCHED POSITION

OPEN POSITION

WIRELINE CORE BARREL

BACKGROUND OF THE INVENTION

The present invention relates to a core barrel for retrieving a core in a drill string.

During the drilling of the earth's formations, it is important to obtain samples of the earth at each point along the depth of the hole. Customarily, the samples are formed by using a hollow rotary drill string or drill stem having a cutting bit at the lower end thereof, which produces a core of earth within the drill string as the bit drills into the earth. The core is retrieved from within the drill string by placing an empty tube portion of a core barrel slightly above the drill bit, and after the tube is filled with the core, raising the core barrel to the earth's surface, where the contents of the tube are analyzed.

Many core barrels have been developed for retrieving cores in a drill string. Such devices ideally should be capable of being readily attached and disattached from the drill string at a particular location thereof and should be reliable in operation, not subject to breakage, and not subject to becoming snagged along the drill string. Moreover, since during the drilling operation, air or other fluid is pumped down through the drill string, around the drill bit, and up through the annulus between the drill string and the wall of the hole drilled for such purposes as removing cuttings from the bottom of the drill hole, it is also important that the core barrel permits an unimpeded flow of such air or other fluid.

The present invention was developed primarily as a result of efforts to accomplish each of the aforementioned goals associated with the design of a core barrel. A patentability search was conducted for the present invention and the following patents were uncovered:

| U.S. Pat. No. | Inventor | Issue Date |
|---|---|---|
| 2,263,639 | A. Muhlbach | Nov. 25, 1941 |
| 3,047,081 | J. N. Pitcher | July 31, 1962 |
| 3,103,981 | A. E. Harper | Sep. 17, 1963 |
| 3,127,943 | T. Mori | April 7, 1964 |
| 3,485,310 | V. Milosevich | Dec. 23, 1969 |
| 3,701,389 | Egnelov et al. | Oct. 31, 1972 |
| 3,739,865 | Wolda | June 19, 1973 |
| 3,323,604 | H. I. Henderson | June 6, 1967 |
| 3,777,826 | Wolda | Dec. 11, 1973 |
| 3,871,487 | Cooper et al. | March 18, 1975 |
| 3,874,464 | Sweeney | April 1, 1975 |
| 3,977,482 | Reed et al. | Aug. 3, 1976 |
| 4,002,213 | Sweeney | Jan. 11, 1977 |
| 4,187,919 | Lambot | Feb. 12, 1980 |
| 4,276,932 | Saliger et al. | July 7, 1981 |
| 4,281,722 | Turker et al. | Aug. 4, 1981 |

U.S. Pat. Nos. 3,739,865 and 3,777,826, both of which are to Wolda, disclose a wire line core barrel. The core barrel includes a pair of resilient latch fingers which are normally retracted away from the drill string. The core barrel is adapted to seal off the drill string and is provided with an actuator adapted to move from a first position to a second position when pressure of the fluid in the drill string above the core barrel exceeds a certain, selected pressure. When the actuator is in the second position, it forces the latch finger outwardly and into a pair of latch seats in the drill string. The section of the core barrel including the latch fingers is connected through bearing means to a core sample container so that when the section including the latch fingers rotates with the drill string, the core sample container will remain relatively stationary. When the core sample container is completely filled with a core, an upward pressure force is applied to the core sample container. This upward force is transmitted to the actuator which is moved back into its first position whereupon the latch fingers tend to snap back naturally away from the drill string and the latch seats therein. A spring may be included in the core barrel assembly to counteract any upward force applied to the core sample container and to resist movement of the actuator until a sufficiently strong force is applied thereto. A pair of holes 80, 82 and 44, 46 in the '865 and '826 patents respectively are provided in the core barrel to permit fluid flow from above and outside the core barrel to the drill bit below the core barrel.

Wolda's U.S. Pat. No. 3,777,826 further discloses a spring which acts upon the actuator such that it tends to bias the same in a position whereby the core barrel seals the drill string.

U.S. Pat. No. 3,485,310 to Milosevich, U.S. Pat. No. 3,127,943 to Mori, U.S. Pat. No. 3,871,487 to Cooper et al., U.S. Pat. No. 2,263,639 to Muhlbach, U.S. Pat. No. 3,701,389 to Egnelov et al., U.S. Pat. No. 3,977,482 to Reed et al., and U.S. Pat. No. 4,187,919 to Lambot each disclose a wire line core barrel having spring biased latching mechanisms for attaching the core barrel to a drill string.

U.S. Pat. No. 3,047,081 to Pitcher discloses a head for a core sampler tube which has a fluted periphery.

U.S. Pat. No. 3,103,981 to Harper discloses a wire line core barrel assembly having spring biased latching dogs, which dogs are mounted on and rotatable about a pin that is slightly smaller than the hole in the dog through which the pin extends. When the dogs are in a latching position, upward forces applied to the wire line core barrel are transmitted through the dogs, and not the pin.

The remaining patents disclose oil well apparatus of a more general interest.

Filed concurrently with this application and constituting part of the file wrapper of this application are a few snap-shot photographs of three wire line core barrel assemblies: a working embodiment of the present invention, and two competitor's models currently and commonly used in the field. One of the competitior's models includes a pair of spring biased latch dogs and an annular, protruding landing shoulder separating an ingress hole and an egress hole in the assembly. The landing shoulder is designed to rest upon and abut a corresponding landing ring on the interior wall of the drill string. Fluid within the drill string must flow throughout the ingress hole and back out the egress hole, thereby providing a relatively inefficient means for the flow of air or other fluid past the wire line latch assembly. The above-described '482 patent to Reed et al. discloses a core barrel having such ingress and egress holes (see Column 4, lines 54–58 thereof). The other competitor's model includes a cylindrical block to the periphery of which are attached four longitudinally extending locking prongs. The locking prongs are slightly radially outwardly biased to contact the interior wall of the drill string and to hang the wire line core barrel assembly by attachment to the drill string at a preselected location therein without any use of a landing ring. Several problems are associated with this device. Because the prongs are long and the latch assembly freely rotates within the drill string, the prongs are twisted, which sometimes causes the prongs to break or causes the bolts holding the prongs to the cylindrical block to loosen and thus stimulate prong disattachment or breakage. Also, the cylindrical block is formed with a flat upper longitudinal end, thereby providing a source of great friction and turbulence for any air or other fluid passing through the drill string.

The Patent Examiner is encouraged to review each of the above-listed patents and the snap-shot photographs accompanying this application for his own independent evaluation concerning the relevance thereof to the present invention.

SUMMARY OF THE INVENTION

Briefly, the present invention relates to a wire line core barrel for retrieving a core in a drill string. The core barrel includes a cylindrically shaped retrieving assembly axially aligned and connected to a generally cylindrically shaped positioning assembly. The positioning assembly includes a generally cylindrical, elongate body, the periphery of which is fluted with a series of longitudinal ribs and channels. Mounted on at least one rib is a spring biased locking dog for protruding into a corresponding slot in the interior wall of the drill string. Also mounted on each rib is a latching dog adapted to extend into a corresponding annular groove in the interior wall of the drill string. When the core barrel is supported by a landing ring or the like in the drill string, the retrieving assembly automatically presses against the latching dogs and urges them into the corresponding annular groove in the interior wall of the drill string. Thus, the locking dog serves to maintain the core barrel in constant rotation with the drill string, whereas the latching dogs serve to prevent longitudinal movement of the core barrel. The tube assembly may be retrieved by pulling upwardly on the retrieving assembly, which permits the latching dogs to move inwardly, away from the groove in the interior wall of the drill string and thereby permits the entire assembly to be lifted to the earth's surface.

The wire line core barrel of the present invention is reliable in operation, is rugged and sturdy, and permits a relatively unimpeded flow of air or other fluid through the drill string, particularly through the outer radial regions surrounding the assembly.

BRIEF DESCRIPTION OF THE DRAWINGS

The invention will be described with reference to the accompanying drawings, wherein:

FIG. 2B depicts the latch assembly in a latched position where the retrieving assembly and the positioning assembly are in their closest relation, FIG. 2A depicts the latch assembly in an open position where the retrieving assembly and the positioning assembly are relatively far apart.

DESCRIPTION OF A PREFERRED EMBODIMENT

Figure 1:
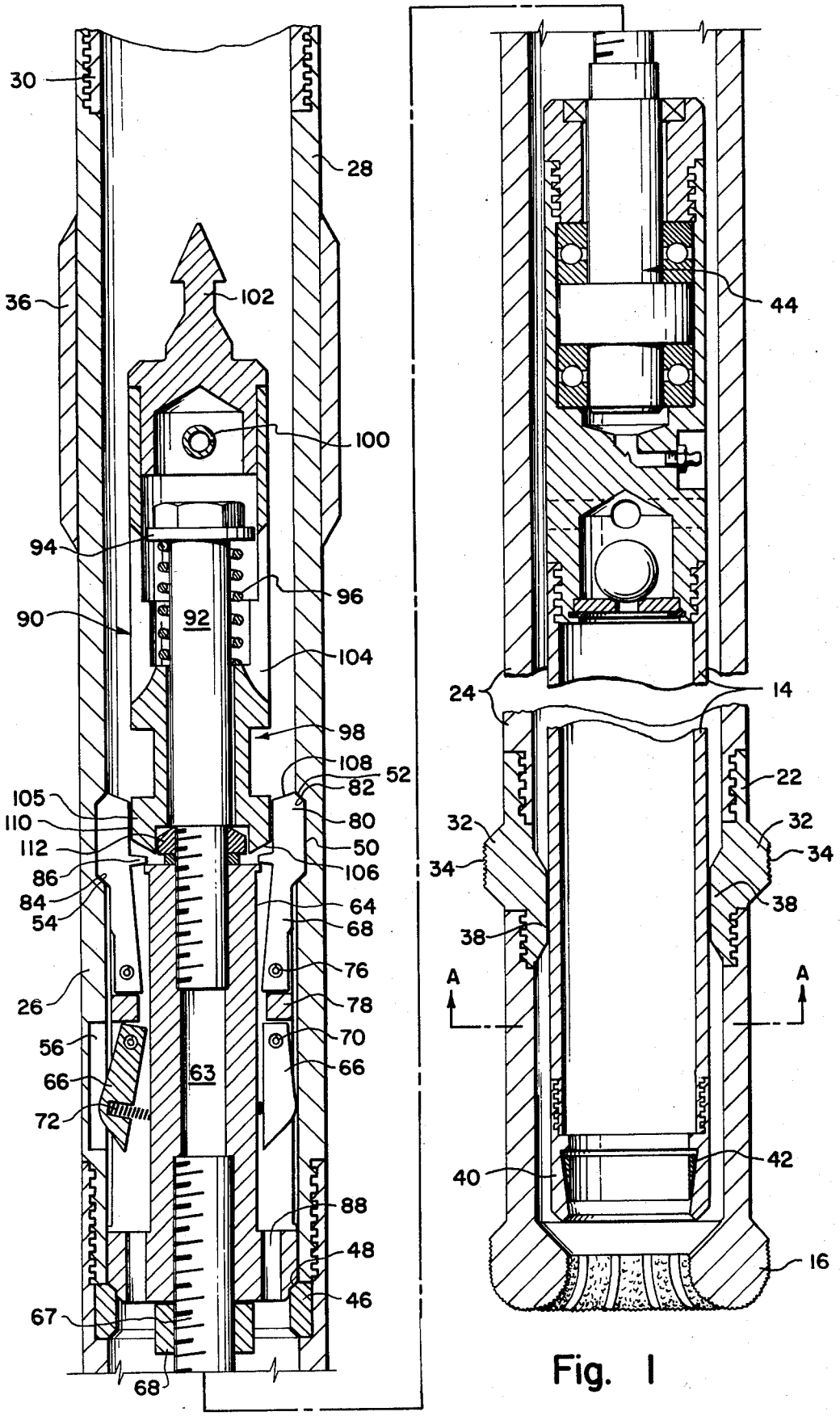
FIG. 1 is a part longitudinal sectional view of one embodiment of a wire line core barrel and its associated inner tube as viewed in a working environment for a core drilling operation, in accordance with one embodiment of the present invention.

Referring now to the drawings wherein like reference numerals and symbols refer to the same item, there is shown in FIG. 1 a wire line core barrel of the present invention including a retrieving assembly 10 and a positioning assembly 12 (together referred to as the latch assembly) for maneuvering and positioning an object such as an inner tube 14 within a hollow, cylindrically shaped, drilling pipe or string at the lower end of which is a drill bit 16.

As the drill bit string is rotated, the drill bit 16 cuts into the earth, thereby producing fine particulate cuttings in the region surrounding the drill bit 16 and thereby producing a cylindrical core of earth within the drill string. It is important to remove the cuttings from the region around the drill bit 16, otherwise the drill bit 16 will tend to grind the cuttings rather than the uncut formation below the drill bit 16. Normally, the cuttings are washed from the region around the drill bit 16 and the drill bit 16 is cooled by passing air or other fluid down through the drill string, around the drill bit 16, and up between the drill string and the drilled hole wall. Also, it is important periodically to sever the core within the drill string and raise the same to the earth's surface for analysis.

Figure 8:
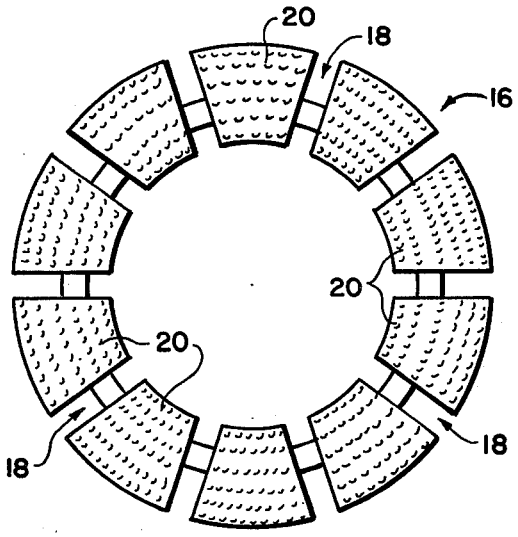
FIG. 8 is a bottom view of the drill bit of the drill string shown in FIG. 1.
Figure 9:
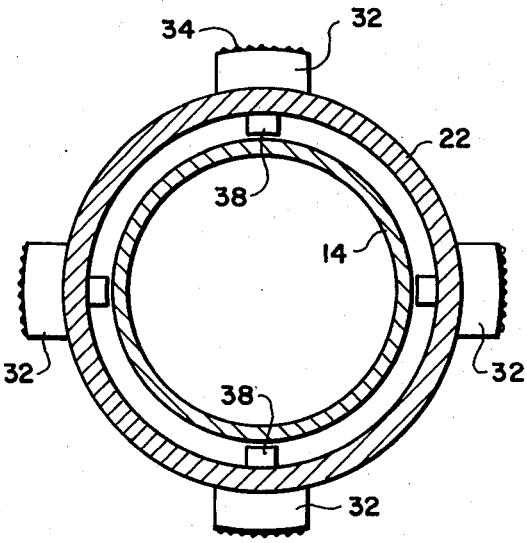
FIG. 9 is a cross sectional view of the drill string and core barrel as taken along the line A—A of FIG. 1.

As shown in FIG. 8, the drill bit 16 is provided with a series of equiangularly spaced, radial passages 18 at its tip thereby providing a means for air or other fluid passing down through the interior of the drill string to pass around the drill bit 16 and up between the drill string and the drilled hole wall. The drill bit cutting surface 20 is usually impregnated with diamonds, either natural or man-made. The choice of drill bit design depends primarily upon the features and characteristics of the earth formations being cut.

The drill string shown in FIG. 1 comprises a number of special sections near the lower end thereof. In addition to the drill bit 16, the drill string includes a reamer shell 22, an outer tube 24, a latch sub 26, a stabilizer coupling 28, and a drill rod 30, all of which are threadably interconnected in series. The outer surface of the reamer shell 28 carries a plurality of equiangularly spaced, protruding, side wall cutting and stabilizing lugs 32 provided with a peripheral cutting surface 34. In addition to stabilizing the drill string during cutting operations, the cutting and stabilizing lugs 32 insure that the drilled hole maintains the desired diameter in the event the drill bit 16 shrinks in diameter due to wear. The outer surface of the stabilizer coupling 28 is also provided with a plurality of equiangularly spaced, protruding stabilizing lugs 36 for stabilizing the drill string within the drilled hole. The inner surface of the reamer shell 22 is provided with a plurality of equiangularly spaced, inwardly extending, guide bars 38 that maintain the inner tube 14 in coaxial alignment with both the surrounding drill string and the core, thereby insuring that the core may enter the inner tube without hitting the inner tube 14 and causing damage to the core or the core barrel parts.

To sever and retrieve the core, it is conventional to use an inner tube 14 conventionally comprising a generally cylindrically shaped, hollow tube, of a length sufficient for obtaining any selected core length up to about six meters. The dimensions of the inner tube 14 are selected to permit the same to envelope the core sample, yet permit substantial air or other fluid flow in the annulus formed between the inner tube 14 and the surrounding drill string. The internal surface of the lowermost end of the inner tube 14 typically is provided with a core spring shoe 40 containing a core spring 42. The core spring is severed longitudinally to permit its radial distension and is allowed slight longitudinal displacement within the core spring shoe 40. Within the region of longitudinal displacement of the core spring 42, the core spring shoe 40 has an internal diameter that tapers to its smallest dimension near the tip thereof. As a consequence of this construction, the core is allowed to enter the inner tube 14 by pushing the core spring 42 upwardly and distending it outwardly. However, when the inner tube assembly is raised within the drill string with a core sample within its inner tube 14, the core sample acts on the core spring 42 to force the same downwardly so that the core spring 42 pinches and squeezes the core sample thereby to retain the same within the inner tube 14.

The latch assembly of the core barrel is threadably connected to the inner tube 14 in a conventional manner by means of a ball bearing assembly 44, which permits the inner tube 14 to rotate with respect to the drill string and to remain stationary with respect to the core sample contained therein. If the inner tube 14 were to rotate with respect to the core sample, any contact between the inner tube 14 and the core sample would cause damage to the core sample.

The drill string includes a latch sub 26 positioned between the outer tube 24 and the stabilizer sub 28. The latch sub 26 is disposed above an inwardly protruding landing ring 46 for engaging and supporting a landing shoulder 48 of the lower longitudinal end of the positioning assembly 12. The position of the landing ring 46 with respect to the drill bit 18 is selected such that the inner tube 14 will be properly positioned with respect to the drill bit 18 when the positioning assembly 12 abuts and rests upon the landing ring 46. The internal diameter of the landing ring 46 is selected such that the inner tube 14 and ball bearing assembly 44 will readily pass therethrough. The latch sub 26 is also provided with an annular groove 50 in the interior wall thereof. The upper and lower longitudinal walls 52, 54 of the annular groove 50 are beveled. The function of the groove 50 will be discussed later herein. The latch sub 26 is also provided with a plurality of radially spaced locking dog slots 56 in the interior wall thereof. The locking dog slots 56 are positioned above the landing ring 46 and below the annular groove.

Figure 6:
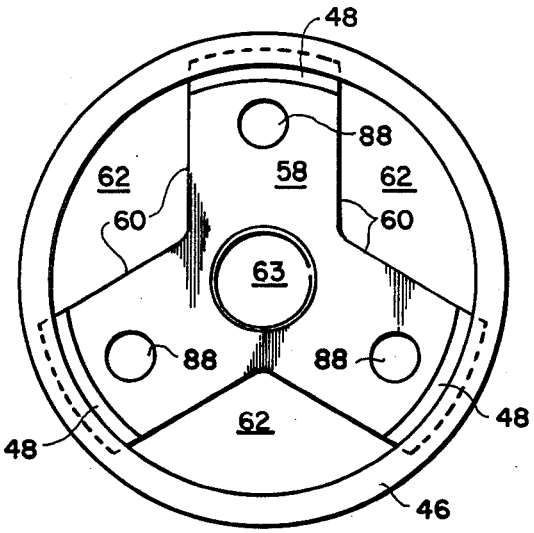
FIG. 6 is a bottom view of the positioning assembly of the core barrel shown in FIG. 1 without the locking dog and latching dogs attached thereto, the positioning assembly being shown resting upon an associated landing ring.
Figure 7:
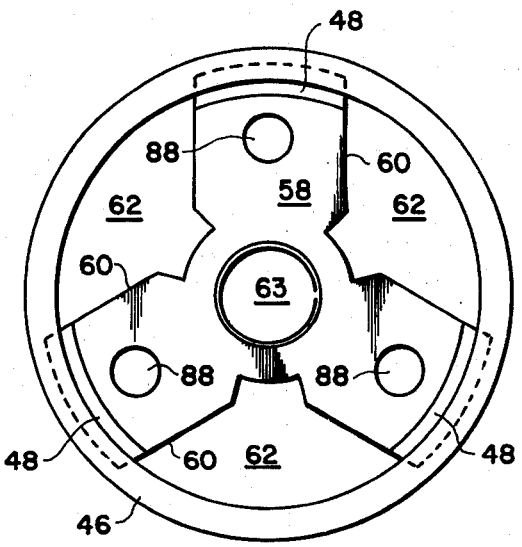
FIG. 7 is a bottom view of another positioning assembly capable of being used with the core barrel shown in FIG. 1 without the locking dog and latching dogs attached thereto, the positioning assembly being shown resting upon an associated landing ring.

The positioning assembly 12 includes a generally cylindrical, elongate body 58 provided with three equiangularly spaced, radially extending, longitudinal ribs or fins 60, as best shown in FIGS. 2, 6 and 7. The radius of extension of each rib 60 is approximately slightly less than the interior radius of the latch sub 26 of the drill string. Between each rib 60 is an associated "V-shaped" channel 62 as shown in FIGS. 6 and 7. The ratio of the radial depth of each channel 62 to the radius of extension of an adjacent rib 60 is between approximately one-fifth and seven-eighths. The preferred ratio as shown in FIGS. 6 and 7, is approximately one-half. As will be appreciated more fully hereinafter, it is preferred that the channels 62 are wide and deep, however, the ribs 60 must be thick and strong enough to withstand the strong forces often bearing upon them during use. The channels 62 provide a void outer radial region between adjacent ribs 60, thereby forming a longitudinal passageway for fluids flowing within the drill string. Thus, the channels 62 permit a smooth, straight flow of air or other fluid and allow a maximum volume of fluid to reach the drill bit 16.

The configuration of the ribs 60 shown in FIG. 7 provides channels 62 wider at the deepest part thereof than the channels 60 shown in FIG. 6. The rib configuration shown in FIG. 7 is preferred for fluids of a relatively heavy viscosity such as a slurry of cement or mud.

Although the elongate body 58 depicted in FIGS. 2A, 2B, 6 and 7 is shown with three ribs 60 and three associated channels 62, it should be appreciated that the elongate body 58 can be constructed with two or more ribs 60 and two or more corresponding channels 62, depending upon the preferences and requirements of the designer and the driller.

The elongate body 58 is provided with an axial borehole 63 therethrough, the ends of which are threaded. The lowermost threaded end of the borehole 63 is adapted for threadably receiving a threaded end of a shaft 67 attached to the bearing assembly 44. Threadably mounted on the shaft 67 adjacent to the elongate body 58 is a jam nut 68. The jam nut 68 prevents the shaft 67 from rotating with respect to the elongate body, which otherwise might cause their disattachment. Also, the position of the jam nut 68 is adjustable for altering the longitudinal spacing between the tip of the drill bit 16 and the tip of the inner tube 14.

Figure 3:
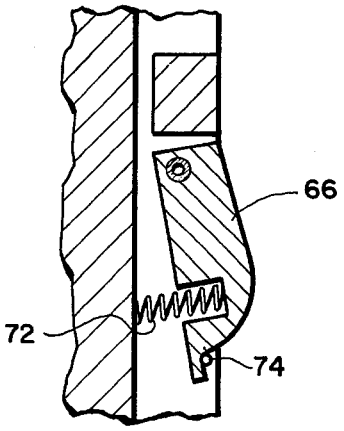
FIGS. 3 through 5 are schematic side cross sectional views of three different embodiments of a locking dog capable of being used with the positioning assembly of the core barrel shown in FIG. 1.
Figure 4:
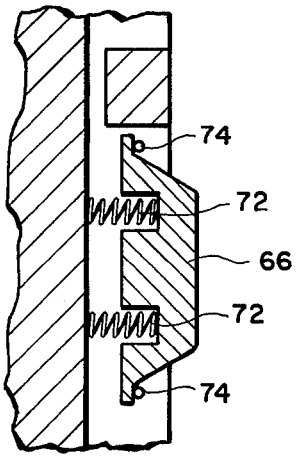
Figure 5:
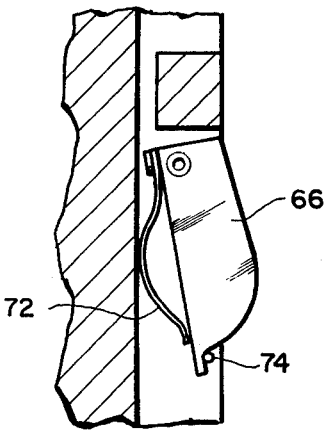

Each longitudinal rib 60 of the elongate body 58 is provided with a longitudinal slot 64 therein opening to the upper end of the positioning assembly 12 for housing a locking dog 66 and a latch dog 68. The locking dog 66 is radially pivotable about a pin 70 extending through the corresponding rib 60 and the locking dog 66. A compression spring 72 is mounted in the longitudinal slot 64 for biasing at least a portion of the corresponding locking dog 66 radially outwardly for engagement with the interior wall of the drill string and for protrusion into a locking dog slot 56 in the latch sub 26. A variety of combinations of locking dogs 66 and compression springs 72 are disclosed in FIGS. 1, 3, 4 and 5. It should be noted that each of the locking dogs 66 disclosed in these drawings has a convex outer surface so that when the core barrel translates within the drill string, the locking dog 66 will readily laterally displace as it engages any protrubances or other changes of diameter of such interior wall such as upsets commonly protruding inwardly in the region of threadable joinder of drill rod sections. The locking dog 66 shown in FIGS. 1, 3, and 4 are biased radially outwardly by means of coil springs bearing upon the bottom wall of the longitudinal slot 64 and resting within corresponding holes in the underside of the locking dogs 66 and bearing against the bottom wall of such holes. The locking dog 66 shown in FIG. 5 is biased by means of a leaf spring which is attached to the underside of the locking dog 66 and which bears against the bottom wall of the longitudinal slot 64. The locking dog 66 disclosed in FIG. 4 does not pivot about a pin extending therethrough, but rather, is confined and limited with respect to longitudinal translation and to radially outward translation thereof in its associated slot 64 by means of two pins 74 extending across the slot.

The position of the locking dog 66 and the locking dog slots 56 provided in the interior surface of the latch sub 26 are selected such that when the elongate body 58 rests upon the landing ring 46, the locking dog 66 and their associated slots 56 in the latch sub 26 are longitudinally aligned. Preferably only one locking dog 66 is utilized at any time, however, if the locking dog 66 or its slot 56 should become distorted through use, then that locking dog 66 may be removed and a new locking dog 66 may be placed in one of the other slots 56. If the locking dog 66 and the locking dog slot 56 in the latch sub 26 do not exactly radially align when the elongate body 58 rests upon the landing ring 46, a slight rotation of the drill string with respect to the positioning assembly 12 will cause the locking dog 66 to protrude into the corresponding locking dog slot 56 in the latch sub 26. Thereby, rotation of the drill string is transmitted through the locking dog 66 to the positioning assembly 12, but, because of the bearing assembly 44 connecting the positioning assembly 12 with the inner tube 14, the inner tube 14 rotates relative to the drill string and remains stationary relative to the core sample confined in the inner tube 14.

Figure 2B:
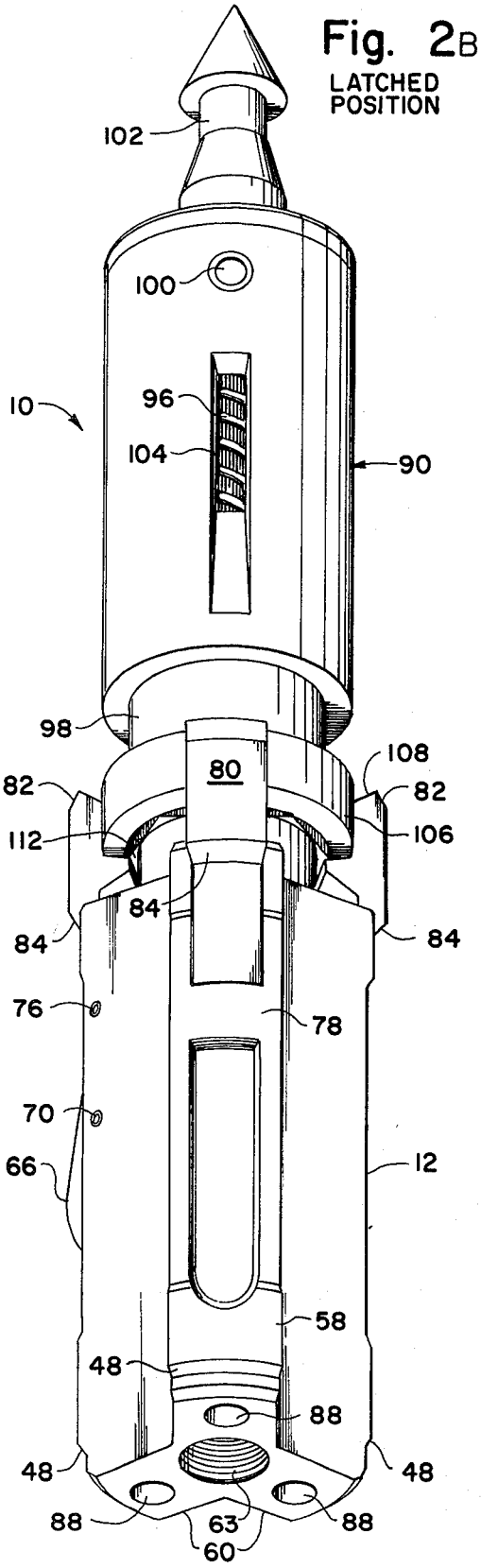
FIGS. 2A and 2B are perspective views of the retrieving assembly and the positioning assembly (together referred to as the latch assembly) of the core barrel shown in FIG. 1.
Figure 2A:
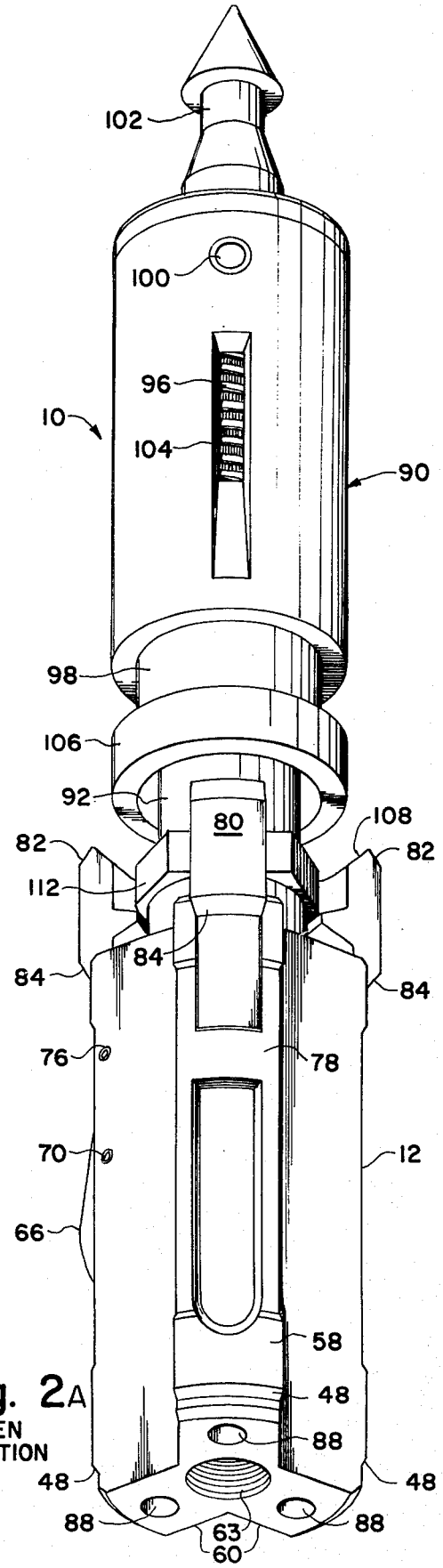

Each longitudinal slot 64 in the ribs 60 of the positioning assembly 12 partially houses a latch dog 68. Each latch dog 68 is rigid and inflexible and preferably is formed of steel. Each latch dog 68 is radially pivotable about a pin 76 extending through the lower portion thereof and through the corresponding rib 60. Each pin 76 extends through a hole in the corresponding latch dog 68, the hole being of a larger diameter than the diameter of the pin 76 and selected such that the latch dog 68 may longitudinally translate within the longitudinal slot 64 and may rest upon a cross bar 78 mounted in the longitudinal slot 64 between the latch dog 68 and the locking dog 66. The cross bar 78 may be mounted by welding the bar 78 to the opposing side walls of the longitudinal slot 64, or, if the positioning assembly 12 is cast, then the cross bar 78 may also be cast. Although as shown in FIGS. 1, 2A and 2B, the cross bar wall facing the latch dog 68 is planar and the adjacent end of the latch dog 68 is also planar, the cross bar wall may be curved such as a semi-circular and the adjacent end of the latch dog 68 may be correspondingly curved. Each latch dog 68 is provided with an upper head section 80 having its outside surface contoured correspondingly to the longitudinal contour of the annular groove 50 in the latch sub 26 so that the head 80 of each latch dog 68 may protrude into and rest within the annular groove 50. Thus the outside surface of the latch dog head 80 is provided with a beveled upper edge 82 and a beveled lower edge 84. Because of these beveled edges 82, 84, the latch dog head 80 will ride freely over bumps such as upsets on the interior wall of the drill string and will prevent the latch dog 68 from snagging on the drill string. Each latch dog 68 is also provided with an inwardly extending lip 86 located adjacent to, and slightly above, the edge of the upper longitudinal end of the elongate body 58. The lip 86 prevents particles such as stones from entering the longitudinal slot 64, and thus inhibits malfunctioning of the latch dog 68.

As shown in FIGS. 2A, 2B, 3, 4 and 5 there is a space between the cross bar 78 and the bottom wall of the longitudinal slot 64 on each longitudinal rib 60 and there is another hole or aperture 88 between the longitudinal slot 64 and the edge of the lower longitudinal end of the elongate body 58 on each longitudinal rib 60. Although the holes 88 are shown as being circular, it should be recognized that the holes may be of any configuration. Preferably, the holes 88 and longitudinal slots 64 are longitudinally aligned, thereby providing a straight line passage for fluids through each rib 60. Moreover, such fluid passage tends to flush the longitudinal slots 64 of any small particulate matter such as grains of sand.

The retrieving assembly 10 includes a generally cylindrically shaped housing 90 provided with an axial borehole therethrough. The borehole has regions of different diameters, with the uppermost region having the greatest diameter, the intermediate region having an intermediate diameter, and the lowermost region having the smallest diameter. A bolt 92 having a diameter approximately equal to the diameter of the lowermost borehole region extends through the borehole. A washer 94 having an outside diameter approximately equal to the diameter of the uppermost borehole region extends around the bolt 92 near the head thereof, both the head of the bolt 92 and the washer 94 being disposed in the uppermost region of the borehole. A compression spring 96 surrounds the bolt 92 and extends between the washer 94 and the shoulder formed between the intermediate region and the lowermost region of the borehole.

The lower outside periphery of the cylindrical housing 90 is provided with a so-called "bail groove" 98, and the top of the cylindrical housing 90 is attached by means of a pin 100 to pinnacle 102 by which the inner tube assembly may be grasped by a pick-up device or the like for longitudinally moving the same within the drill string.

The cylindrical housing 90 may be provided with a pair of longitudinal slots 104 therethrough so that fluid may flow between the borehole and the exterior of the housing 90, thereby keeping the borehole free of particulate matter. As shown in FIG. 1, the longitudinal slots 104 are formed with a circular cutter whereby the end walls of the slots 104 are curved, thereby facilitating smooth flow of fluid and the removal of particulate matter from within the housing. Moreover it should be noted that the lower end wall of the slots 104 is formed slightly below the shoulder upon which the compression spring 96 rests and the upper end of the wall of the slot 104 is formed well above the shoulder formed between the upper region and the intermediate region of the borehole.

The lower end 105 of the cylindrical housing 90 below the bail groove 98 functions as a plunger against the heads 80 of the latch dogs 68. The outer radial region or edge 106 of the lower end 105 is chamfered for normally engaging a correspondingly chamfered upper edge 108 of each latch dog head 80. The periphery of the cylindrical housing 90 in the region of the lower end 105 very slightly tapers in diameter from the chamfered edge 106 to the bail groove 98, and likewise, the inner edge 110 of each latch dog head correspondingly very slightly tapers, except the taper is in the opposite direction. It has been determined that when the lower end 105 urges the latch dog heads 80 into the correspondingly shaped annular groove 50, the tapers of the lower end periphery and the inner edges 110 of each latch dog 68 resist forces which otherwise tend to move the cylindrical housing upward and to dislodge the latch dog heads 80 from the annular groove 50.

The retrieving assembly 10 is attached to the positioning assembly 12 by screwing the bolt 92 into the upper threaded end of the axial borehole 64 of the elongate body 58 of the positioning assembly 12. A second jam nut 112 is threadably mounted on the bolt 92 adjacent to the upper longitudinal end of the elongate body 58. The jam nut 112 prevents the bolt 92, and hence the retrieving assembly 10, from disattaching from the positioning assembly. The longitudinal height of the jam nut 112 is selected such that the chamfered edge 106 of the housing lower end 105 is prevented from contacting the inwardly extending lip 86 of each latch dog 68, which otherwise might cause damage to the chamfered edge 106 or the lips 86. The portion of the jam nut 112 closest to the elongate body 58 is radially recessed to accomodate radially inward movement of the lips 86 and the latch dog heads 80.

The housing 90 of the retrieving assembly 10 and the elongate body 58 of the positioning assembly 12 have their longitudinal axes substantially aligned. The very small tolerances between the washer 94 and the surrounding housing 90 and between the washer 94 and the bolt 92 prevent the retrieving assembly 10 from significant misalignment or wobbling with respect to the positioning assembly 12.

The chamfered edge 106 of the housing lower end 105 normally contacts the correspondingly chamfered upper edge 108 of the heads 80 of each latching dog 68 because the force of the spring 96 causes the housing 90 to press toward the positioning assembly 12. The shape of the chamfered edge 106 and the chamfered upper edge 108 of the latch dog heads 80 are such that when the housing 90 is so pressed toward the positioning assembly 12, the housing 90, particularly the lower end 105 thereof, acts like a plunger, forcing the latch dog heads 80 radially outwardly so that when the heads 80 align with the annular groove 50, the heads 80 are urged into the annular groove 50 in the latch sub 26.

Air or other fluid flowing down through the drill string will pass through the annulus formed between the housing 90 of the retrieving assembly 10 and the drill string, will pass through both the longitudinal slots 64 and holes 88 of the ribs 60 of the elongate body 58 and the longitudinal channels 62 formed by the elongate body 58, and then will pass through the annulus formed between the inner tube 14 and the drill string. The passageways for the air or other fluid in the region of the latch assembly and the inner tube 14, and particularly in the region of the elongate body 58, are generally in the outer radial regions within the drill string. Thus, the air or other fluid may flow in a relatively straight, longitudinal path past the latch assembly and its associated inner tube 14 with relatively little friction or turbulence. Moreover, there are no protruberances within the longitudinal paths that would create turbulence. Consequently, very little pressure is needed too maintain a relatively great rate of air or other fluid flow through the drill string. Because the core barrel of the present invention permits a relatively great rate of air or other fluid flow through the drill string, the drill bit 16 may be cooled much more efficiently and the cuttings of the drill bit 16 may be washed away much more quickly and thoroughly, thereby permitting a faster rate of drilling. Persons who have observed the operation of a working embodiment of the present invention in the field and who have witnessed the operation of other core barrels currently and commonly used in the field, have noted that the working embodiment of the present invention permits drilling rates sometimes considerably faster than the drilling rates associated with the other currently and commonly used assemblies, even with a lesser fluid pressure.

In one operation of the present invention, a wire line (not shown), usually a strong steel cable, is attached to a pick-up device (not shown), which in turn grasps the pinnacle 102 of the retrieving assembly 10. Then, the latch assembly together with the bearing assembly 22 and the inner tube 14 is lowered within the drill string. The weight of the various elements attached to, and depending from, the bolt 92 in the retrieving assembly 10 acts against the bias of the compression spring 96 in the retrieving assembly 10 such that the cylindrical housing 90 is disposed axially away from the latch dogs heads 80 of the positioning assembly 12. When the positioning assembly 12 abuts and rests upon the landing ring 46, the bias of the compression spring 96 forces the cylindrical housing 90 axially downwardly such that the chamfered edge 106 thereof forcefully contacts the chamfered upper edge 108 of each latch dog head 80, thereby forcing each latch dog head 80 radially outwardly and into the annular groove 50 of the latch sub 26. Upon rotation of the drill string, the locking dog 66 will be forced into its corresponding locking dog slot 56 in the latch sub 26, thereby causing the latch assembly to rotate concurrently with the drill string. Such concurrent rotation prevents rotation of the latch dogs 68 with respect to the drill string, which otherwise would cause the region at the drill string contacted by the latch dogs 68 to become thinner from friction of the latch dog heads 80 with the drill string and might seriously weaken the drill string in that region. Because the bearing assembly 44 interconnects the latch assembly and the inner tube 14, the inner tube 14 remains stationary with respect to the core sample and does not rotate with the drill string.

As the drill string and the drill bit 16 rotate and the inner tube 14 gradually fills with the core sample, the inner tube 14 and the latch assembly are sometimes forced upwardly. However, upward movement of the core barrel is inhibited by engagement of the latch dog heads 80, particularly the beveled surfaces 82 thereof, with the upper beveled wall 52 of the annular groove 50. The latch dog heads 80 are prevented from disengaging from the annular groove 50 by abutment of the inner tapered edge 110 of the heads 80 with the tapered periphery of the housing lower end 105. In this context, it should be noted that the upward force is transmitted from the cross bar 78 through each latch dog 68 and into the upper beveled wall 52 of the annular groove 50. The pins 76 by which latch dogs 68 are connected to and pivotable with respect to the elongate body 58 bear none of the load or force.

When the inner tube 14 is filled, the entire inner tube assembly may be raised to the earth's surface by reattaching the pick-up device to the pinnacle 102 of the retrieving assembly 10 and then reeling in the wire line. Again, the weight of the various elements attached to, and depending from, the bolt 92 in the retrieving assembly 10 acts against the bias of the compression spring 96 to displace the cylindrical housing 90 axially away from the head 80 of each latch dog 68. The upper beveled wall 52 of the annular groove 50 and the beveled edge 82 of the latch dog heads 80 are so inclined that further pulling of the wire line upon the retrieving assembly 10 causes the latch dog heads 80 to move radially inwardly, away from the annular groove 50, to permit the entire inner tube assembly to be raised to the earth's surface. Excessive compression of the spring 96 during lowering or raising of the core barrel is prevented by abutment of the washer 94 surrounding the bolt 92 with the shoulder formed between the upper region and the intermediate region of the borehole in the cylindrical housing 90.

Another operation of the present invention is utilized in core holes having a large amount of water or other fluid within the drill string. In such a situation, the core barrel is not lowered by a wire line, but rather, is simply dropped in the drill string. First, the housing 90 is manually pulled away from the positioning assembly 12, then the inner tube assembly is released into the drill string. In this situation, the presence of the fluid within the drill string adds a force resisting the rapid descent of the inner tube assembly.

The core barrel of the present invention may also be utilized without the use of the landing ring 46. In this circumstance, the inner tube assembly is allowed to descend to the very bottom of the drill string such that the core spring shoe 40 abuts the drill bit 16. As rotation of the drill string produces a core, the core will contact the core spring shoe 42 and push the entire inner tube assembly upwardly until the locking dogs 66 and the latch dog heads 80 are longitudinally aligned with their corresponding slots 66 and annular groove 50, respectively, in the latch sub 26. Thereupon, the core barrel will be locked in a constant longitudinal position, and further pressure of the core against the core spring shoe will simply cause the core to extend into the inner tube 14. When the core barrel is used in this fashion, it is customary to provide gaps along the tip of the core spring shoe 42 so that air or other fluids within the drill spring may pass by the core spring shoe tip and around the drill bit 16.

Although particular embodiments of the present invention have been described and illustrated herein, it should be recognized that modifications and variations may readily occur to those skilled in the art and that such modifications and variations may be made without departing from the spirit and scope of our invention. Consequently, our invention as claimed below may be practiced otherwise than is specifically described above.

We claim:

1. A core barrel for retrieving a core within a substantially cylindrically shaped, tubular, generally vertically oriented, core drilling string, the interior wall of the drill string being provided with a region of abrupt diameter change wherein the smaller diameter section of the region lies above the larger diameter section of the region, said core barrel including:

an elongate, generally cylindrically shaped body having a fluted periphery comprising at least two longitudinal ribs and channels, said elongate body adapted to be disposed within the drill string such that the channels thereof are oriented substantially parallel to the axis of the drill string, whereby when said elongate body is disposed within the drill string and a fluid flows within the drill string, the fluid may flow around the periphery of said elongate body, through the channels thereof;

means located on at least one of the ribs of said elongate body, connected to said elongated body, laterally extensible with respect to said elongate body, and adapted for engagement with the interior wall of the drill string when said elongate body is within the drill string; and means for selectively resiliently urging said engagement means laterally outward with respect to said elongate body whereby when said engagement means is selectively urged laterally outward and when said engagement means engages the interior wall below the region of abrupt diameter change, said elongate body is inhibited from upward displacement in the drill string by engagement of the engagement means with the interior wall, said urging means comprising a plunger positioned at one longitudinal end of, and axially displaceable relative to, said elongate body, said plunger comprising a generally cylindrically shaped housing having the axis thereof substantially aligned with the axis of said elongate body, the housing provided with a pinnacle at the longitudinal end thereof away from said elongate body, the housing having an axial borehole extending through the longitudinal end thereof toward said elongate body, the borehole having three regions of different diameters: an uppermost region of greatest diameter, a lowermost region of least diameter, and an intermediate region of intermediate diameter, said plunger further comprising a bolt having a head end thereof disposed in the uppermost region of the borehole and of a width greater than the diameter of the intermediate region of the borehole, having a shaft extending through the borehole and of a width approximately equal to the diameter of the lowermost region of the borehole, and having a shaft end threadably connected to said elongate body, said plunger further comprising a compression spring disposed in the intermediate region of the borehole for acting against the bolt head and the housing such that the housing is biased toward said elongate body.

2. A core barrel according to claim 1 wherein said engagement means comprises a bar or key and wherein the rib on which the said engagement means is located is provided with a slot and wherein the bar is at least partially disposed within the rib slot and wherein said engagement means further comprises a pin extending through the bar and into at least one side wall of the rib slot and wherein the bar is pivotable or rotatable about the axis of the pin and wherein the rib slot opens and the bar extends beyond the longitudinal end of said elongate body toward said plunger and wherein the bar is provided with an internal lip located above and adjacent to the longitudinal end of said elongate body toward said plunger and adapted to cover the open end of the rib slot thereby to inhibit the passage of particulate matter through the open end of the rib slot, the shape of the interior surface of the extending portion of the bar and the shape of the longitudinal end of the housing toward said elongate body being selected such that contact between such interior surface and such housing end causes the bar to be urged laterally outward.

3. A core barrel according to claim 1 wherein the force associated with the weight of the core barrel components supported by the bolt is greater than the force of the compression spring.

4. A core barrel according to claim 2 wherein the force associated with the weight of the core barrel components supported by the bolt is greater than the force of the compression spring.

5. A core barrel according to claim 1 wherein the ratio of the depth to which at least one channel extends into said elongate body to the radius of said elongate body taken along at least one rib thereof is between one-fifth and seven-eighths.

6. A core barrel for retrieving a core within a substantially cylindrically shaped, tubular, core drilling string, said core barrel comprising:

an elongate, generally cylindrically shaped body having a fluted periphery comprising at least two longitudinal ribs and channels, said elongate body adapted to be disposed within the drill string such that the channels thereof are oriented substantially parallel to the axis of the drill string, whereby when said elongate body is disposed within the drill string and a fluid flows within the drill string, the fluid may flow around the periphery of said elongate body, through the channels thereof;

a longitudinal slot in at least one rib;

a cross bar extending across the longitudinal slot, above the bottom wall of the slot, and separating the longitudinal slot into an upper section and a lower section;

a first bar at least partially disposed within the lower slot section, connected to, and laterally extensible with respect to, said elongate body, and adapted for engagement with the interior wall of the drill string;

means for resiliently urging said first bar laterally outward with respect to said elongate body;

a second bar at least partially disposed within the upper slot section, connected to, and laterally extensible with respect to, said elongate body, and adapted for engagement with the interior wall of the drill string;

means for resiliently urging said second bar laterally outward with respect to said elongate body;

said elongate body being provided with at least one longitudinal hole in the rib in which the slot is located, the hole providing a means for fluid communication between the slot and the longitudinal ends of said elongate member.

7. A core barrel according to claim 6 wherein the ratio of the depth to which at least one channel extends into said elongate body to the radius of said elongate body taken along at least one rib thereof is between one-fifth and seven-eighths.

* * * * *